US009334076B2

(12) United States Patent
Flynn et al.

(10) Patent No.: US 9,334,076 B2
(45) Date of Patent: May 10, 2016

(54) CUSTOMIZABLE GIFT BOX LABEL ASSEMBLY

(71) Applicant: Timothy J. Flynn, Key Largo, FL (US)

(72) Inventors: Timothy J. Flynn, Key Largo, FL (US); Geoffrey Brossard, Crystal Lake, IL (US)

( * ) Notice: Subject to any disclaimer, the term of this patent is extended or adjusted under 35 U.S.C. 154(b) by 0 days.

(21) Appl. No.: 14/020,347

(22) Filed: Sep. 6, 2013

(65) Prior Publication Data

US 2014/0209496 A1 Jul. 31, 2014

Related U.S. Application Data

(60) Provisional application No. 61/698,267, filed on Sep. 7, 2012.

(51) Int. Cl.

| | |
|---|---|
| ***G09F 3/00*** | (2006.01) |
| ***B65C 3/08*** | (2006.01) |
| ***G09F 3/02*** | (2006.01) |

(52) U.S. Cl.

CPC ... *B65C 3/08* (2013.01); *G09F 3/02* (2013.01); *Y10T 156/1049* (2015.01)

(58) Field of Classification Search

CPC ..... B65D 5/4233; B65D 25/205; B65D 5/62; G09F 3/20; B09F 1/04

USPC ..... 229/87.18, 87.19

See application file for complete search history.

(56) References Cited

U.S. PATENT DOCUMENTS

| | | | | |
|---|---|---|---|---|
| 2,187,304 | A | | 1/1940 | Farmer |
| 2,529,060 | A | | 11/1950 | Trillich |
| 2,676,897 | A | | 4/1954 | Trillich |
| 3,297,341 | A | * | 1/1967 | Reed et al. ..... 281/34 |
| 3,458,112 | A | | 7/1969 | Nelson |
| 3,559,876 | A | * | 2/1971 | Conescu ..... 229/87.19 |
| 4,700,976 | A | | 10/1987 | Loose |
| 4,863,191 | A | | 9/1989 | Termanis |
| 4,940,258 | A | | 7/1990 | Cuba, Jr. et al. |
| 5,044,547 | A | * | 9/1991 | Hartman ..... 229/175 |
| 5,103,978 | A | * | 4/1992 | Secor ..... 206/387.1 |
| 5,186,566 | A | | 2/1993 | Cameron |
| 5,306,372 | A | | 4/1994 | Hall et al. |
| 5,337,943 | A | | 8/1994 | Hendren |
| 5,449,201 | A | | 9/1995 | Miller et al. |
| 5,800,893 | A | | 9/1998 | Harden |
| 5,893,512 | A | | 4/1999 | Diedrich |
| 5,893,587 | A | | 4/1999 | Wong |
| 5,979,651 | A | | 11/1999 | Betts |
| 6,086,107 | A | | 7/2000 | Whistler et al. |
| 6,096,397 | A | | 8/2000 | Murphy |

(Continued)

FOREIGN PATENT DOCUMENTS

| | | |
|---|---|---|
| JP | 2002-23636 | 1/2002 |
| JP | 2002-225071 | 8/2002 |

(Continued)

*Primary Examiner* — Shin Kim

(74) *Attorney, Agent, or Firm* — Pauley Erickson & Kottis

(57) ABSTRACT

A label assembly for a customizable gift box. The label assembly includes a label and a back sheet having alignment tabs for aligning the box blank to the label. The alignment tabs are raised to expose adhesive material of the label. The box portion is aligned on the adhesive with the tabs, and then the partially adhered label can be fully exposed and wrapped around the box portion. The label can be used as a box bottom or top wrapping, or can form a top for a bottom box portion.

20 Claims, 4 Drawing Sheets

(56) References Cited

U.S. PATENT DOCUMENTS

| | | | |
|---|---|---|---|
| 6,115,999 | A | 9/2000 | Adelman |
| 6,213,518 | B1 | 4/2001 | Raming |
| 6,238,762 | B1 | 5/2001 | Friedland et al. |
| 6,347,703 | B1 | 2/2002 | Betts |
| 6,495,228 | B1 | 12/2002 | Mauch et al. |
| 6,699,541 | B2 | 3/2004 | Finestone et al. |
| 6,730,396 | B2 | 5/2004 | Maloney |
| 6,886,309 | B2 | 5/2005 | Phillips |
| 6,953,207 | B2 | 10/2005 | Raming |
| 7,641,951 | B2 | 1/2010 | Hodsdon et al. |
| 7,726,696 | B2 | 6/2010 | Flynn et al. |
| 7,794,812 | B2 | 9/2010 | Sanford |
| 7,959,187 | B2 | 6/2011 | Flynn et al. |
| 7,963,564 | B2 | 6/2011 | Flynn et al. |
| 8,033,040 | B2 | 10/2011 | Flynn |
| 8,171,661 | B2 | 5/2012 | Flynn et al. |
| 8,209,893 | B2 | 7/2012 | Flynn |
| 8,272,669 | B2 | 9/2012 | Flynn et al. |
| 8,273,433 | B2 | 9/2012 | Flynn |
| 8,419,070 | B2 | 4/2013 | Flynn |
| 8,622,883 | B2 | 1/2014 | Flynn |
| 2002/0093191 | A1 | 7/2002 | Feng et al. |
| 2008/0093427 | A1 | 4/2008 | Kuranda |
| 2008/0141568 | A1* | 6/2008 | Flynn ..... 40/312 |
| 2009/0127322 | A1 | 5/2009 | Miller |
| 2010/0089989 | A1* | 4/2010 | Kwok et al. ..... 229/186 |
| 2011/0147255 | A1 | 6/2011 | Kuranda |
| 2011/0186213 | A1 | 8/2011 | Flynn |

FOREIGN PATENT DOCUMENTS

| | | |
|---|---|---|
| JP | 2005-173300 | 6/2005 |
| WO | WO 92/16436 | 10/1992 |

* cited by examiner

CUSTOMIZABLE GIFT BOX LABEL ASSEMBLY

CROSS REFERENCE TO RELATED APPLICATION

This application claims the benefit of U.S. Provisional Patent Application, Ser. No. 61/698,267, filed on 7 Sep. 2012. The provisional application is hereby incorporated by reference herein in its entirety and is made a part hereof, including but not limited to those portions which specifically appear hereinafter.

BACKGROUND OF THE INVENTION

1. Field of the Invention

This invention is directed to a customizable gift box that includes a box blank and a label assembly with a label having a printable surface and a back sheet having alignment tabs for aligning the box blank to the label.

2. Description of Related Art

Gift boxing and wrapping are necessary components of gift giving. Often, gift givers need dedicated space for wrapping paper of all varieties and boxes of various sizes and shapes to accommodate such gifts. Gift bags are one accommodation to the space requirements of traditional gift boxes and wrapping. However, like wrapping paper, gift bags are generally thematic and not all gift bags are appropriate for all gift giving situations.

As such, a need arises for a customizable gift box that a gift giver may design that is appropriate for the particular gift, event, occasion, season and/or recipient. Such customizable gift boxes eliminate the need for a gift giver to stock and/or independently purchase a tailor-made gift wrap or gift box for each particular gift, event, occasion, season and/or recipient.

SUMMARY OF THE INVENTION

It is an object of the present invention to provide a customizable gift box. The above and other objects of this invention can be attained with a box blank and a label assembly including a back sheet and a face sheet removably adhered to the back sheet. The face sheet has a carrier portion and at least one label. An opposite back sheet is affixed to the face sheet. The face sheet preferably includes an adhesive material coating on one side facing the back sheet and a printable surface on an opposite side. The label assembly is preferably manufactured of a size and material to permit feeding into any number of standard printers, such as a consumer laser printer.

In one embodiment, the label assembly includes an adhesive coated face sheet having a printable surface opposite the adhesive material surface, and including a label cut therein and sized to cover a box blank. A back sheet lining the adhesive material includes a center portion and a removable portion extending around the center portion. The removable portion partially overlays the label and is removable to expose an adhesive surface of the label within the face sheet. A plurality of alignment tabs, such as each extending along a side of the center portion, and separated from the center portion by a tearable line of separation, are raised about a fold line to provide a guide for aligning the label on the box portion.

The label assembly of this invention can include a face sheet including a label sized to cover a box blank, a back sheet including a center portion, and a plurality of alignment tabs extending around and abutting the center portion. A tearable line of separation extends between the center portion and each of the plurality of alignment tabs, and each of the alignment tabs including a fold line opposite the tearable line of separation. The tabs can be detached from the center portion along the tearable line and raised by folding about the fold line to form a guide frame around the center portion. The center portion can be removed or left on during application.

In operation, the method of customizing a box with the label assembly can include: raising the alignment tabs about the fold lines to expose adhesive material; aligning a box blank between the plurality of alignment tabs; adhering the box blank to the adhesive material; and folding the label about the box blank. The label assembly can be preprinted with designs and/or text, or customized by printing the label with a standard printer to include desired designs, writing, etc. appropriate to the situation.

The back sheet preferably includes at least one alignment tab for aligning the box blank. The alignment tab is preferably defined by one or more tearable separation line in combination with a fold line forming a two-dimensional shape such as, but not limited to, a trapezoid, a triangle and a rectangle. The tearable line is preferably a die-cut or other suitable scored or cut line, that extends through the back sheet but not the face sheet. The alignment tab is preferably separable from the face sheet along the scored line to expose a portion of the adhesive and foldable about the fold line such that the alignment tab can be folded to stand at an approximately 90 degree angle to the face sheet. In a preferred embodiment, the fold line includes a line of weakness in the back sheet, such as but not limited to a perforation, scored, or etched line, to improve the foldability along the fold line.

With the one or more alignment tabs in a raised position thereby exposing a partial surface of the adhesive, one or more edges of the box blank can be lined-up with the alignment tabs and a portion of a surface of the box blank is adhered to the partial surface of the adhesive. In a preferred embodiment, the back sheet further includes a removable portion extending from each of the alignment tabs and defined by the fold line and a removable portion score line. The removable portion is preferably separable from the face sheet to expose adhesive under the removable portion. With the adhesive under the removable portion exposed, the box blank can be adhered to the exposed section of the adhesive under the removable portion.

This configuration of this invention facilitates alignment and placement of the label assembly to the box blank without curling or tearing of the label assembly.

Other objects and advantages of this invention are apparent to those skilled in the art, in view of the following detailed description taken in conjunction with the appended claims and drawings.

BRIEF DESCRIPTION OF THE DRAWINGS

The present invention can be better understood with reference to the following drawings. In the drawings, like reference numerals designate corresponding parts throughout the several views. The drawings are not necessarily to scale and emphasis is placed upon clearly illustrating principles of the present invention.

DETAILED DESCRIPTION OF PREFERRED EMBODIMENTS

The present invention is directed to a label assembly 10 for creating a customizable gift box from a box blank. At least a portion of the label assembly 10 is preferably printable or otherwise customizable and then assembled with the box blank to create the customizable gift box.

According to a preferred embodiment of this invention, the box blank is or includes a box top or bottom with at least two, suitably four sidewalls. The box blank may be constructed of cardboard, paper, card stock or other suitable material having similar and/or desirable properties. As used herein, a "gift box" may include a top, a bottom or entire box construction suitable for containing a gift or other object. It is contemplated that the "gift box" may include additional applications aside from gifts, such as business uses, postal uses or any other suitable use that requires a customizable box.

Figure 1:
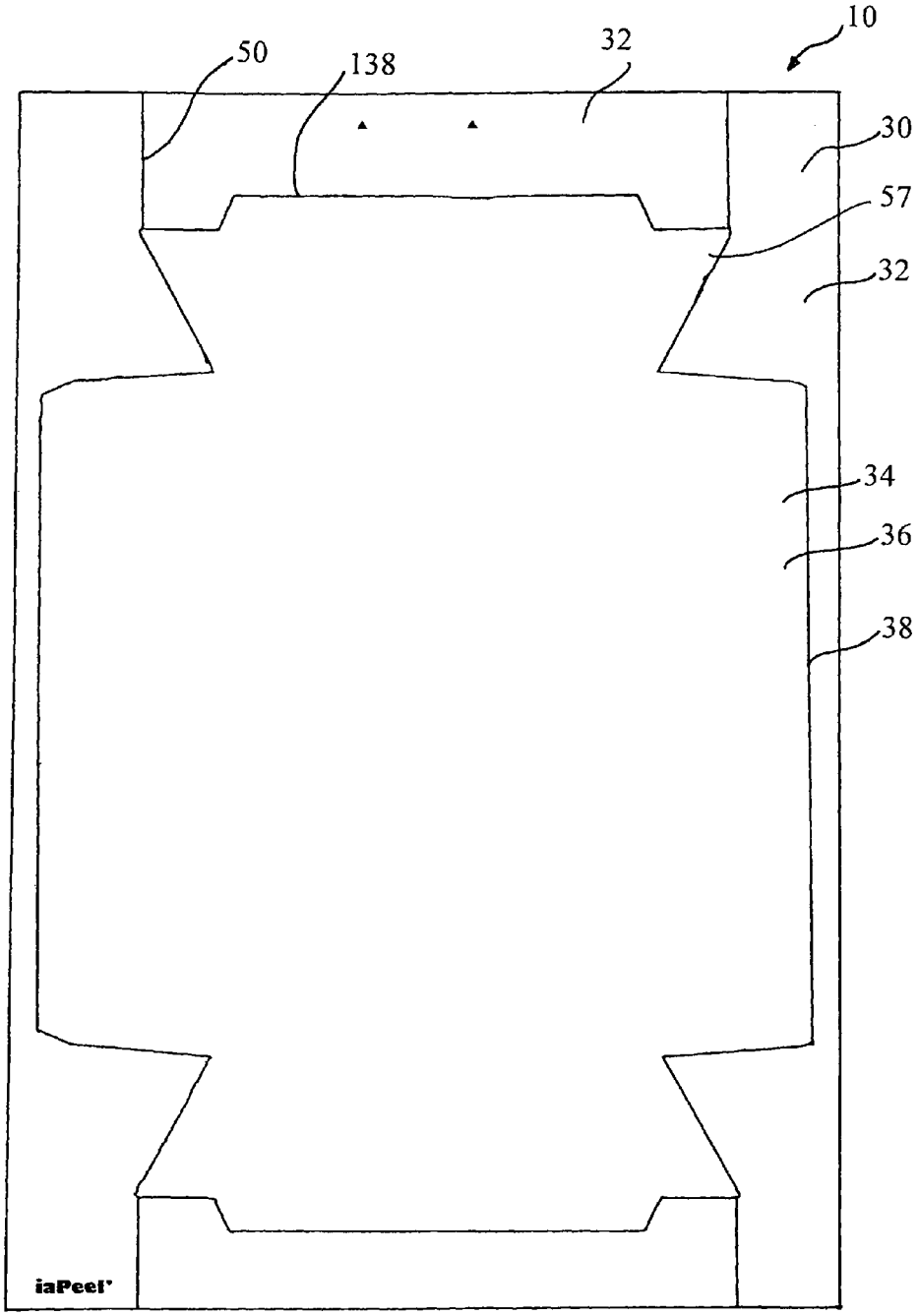
FIG. 1 is a plan view of a face sheet side of a label assembly according to one preferred embodiment of this invention.
Figure 2:
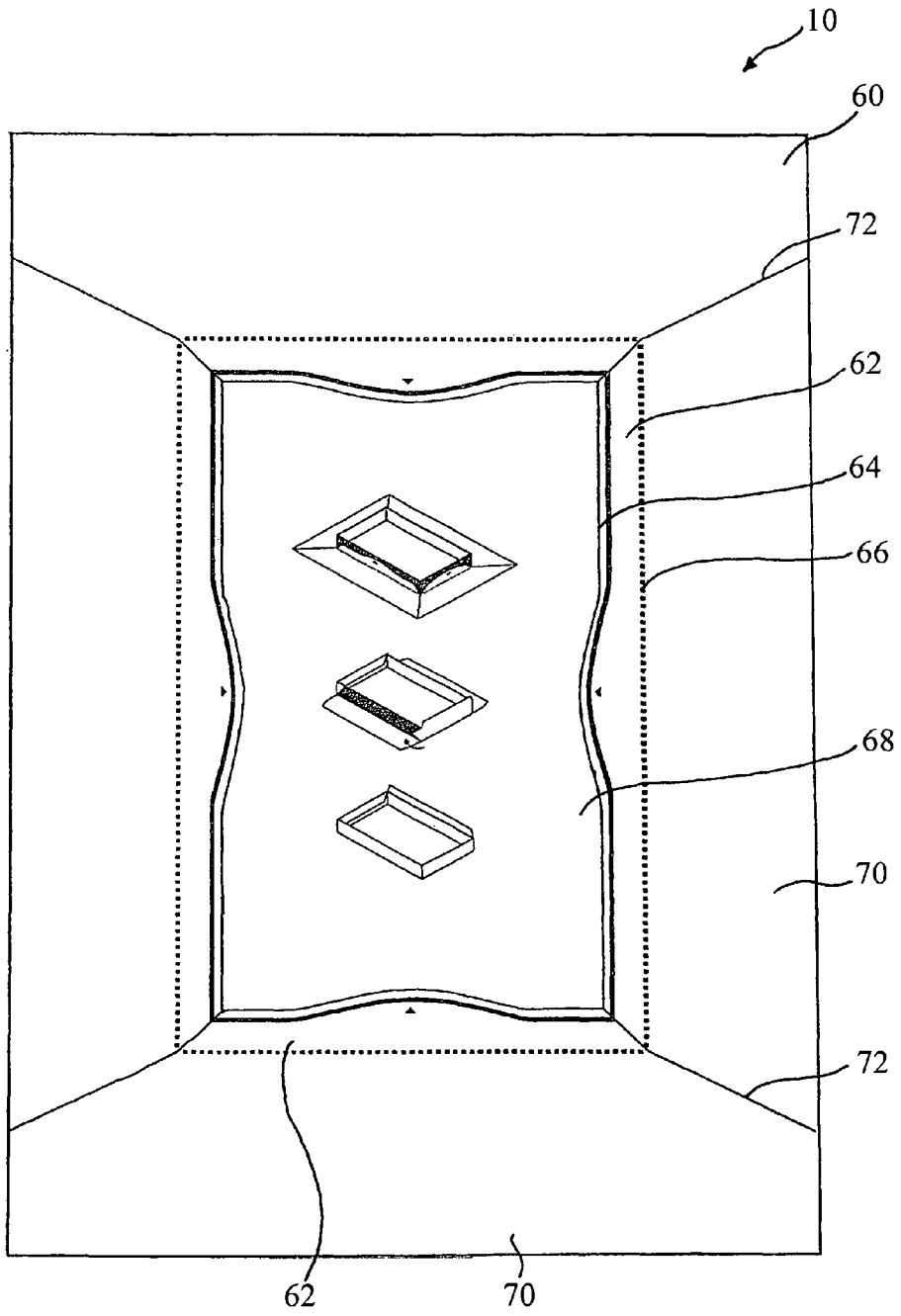
FIG. 2 is a plan view of a back sheet side of a label assembly opposite the face sheet side shown in FIG. 1, according to one preferred embodiment of this invention.

In the embodiment of FIGS. 1 and 2, the label assembly 10 preferably includes a face sheet 30 and a back sheet 60 removably adhered to the face sheet 30. The face sheet 30 preferably includes at least one carrier portion 32 surrounding at least one label 34 that is removable from at least a portion of the back sheet 60 and separable from the carrier portion 32. The label 34 is preferably separated from the carrier portion by a die cut or otherwise scored edge 38 that extends along a perimeter of the label 34 and extends through the face sheet 30 but not the back sheet 60. Alternatively, the scored edge 38 may extend through the face sheet and at least a portion of the back sheet. The label 34 preferably includes at least one printable surface 36 upon which information, decorations, personalization, etc. can be printed to.

The back sheet 60 is desirably approximately the same size as the face sheet 30, but may be slightly larger or smaller than the face sheet 30. A surface of the face sheet 30 that is disposed toward the back sheet 60 preferably includes an adhesive material coating. The adhesive coating can include any adhesive material known and available to those skilled in the art for forming pressure sensitive, or self-adhesive labels.

The label assembly 10 is preferably of any suitable shape, and for home printing generally any suitable size that can be accepted by and fed through a printer, such as a laser printer or an ink jet printer. Common sizes of paper generally fed through printers are 8.5 inches by 5.5 inches, 8.5 inches by 11 inches, 8.263 inches by 11.688 inches (A4 size), and 8.5 inches by 14 inches. The face sheet 30 is preferably, but not necessarily, constructed of any suitable paper, paper composite, non-metal and/or metal material that can be used as a label. Other suitable materials for constructing the face sheet 30 include fabric, plastic, and metal foils. The adhesive coating covered by the back sheet 60 is preferably applied to the face sheet 30 in any suitable manner known to those skilled in the art. The face sheet 30 desirably has a printable surface 36 on a side opposite the adhesive coating. Pre-printed labels can be formed in larger sizes, such as for apparel gift boxes, etc.

The face sheet 30 and the printable surface 36 can be any of a variety of face materials used to make pressure sensitive, or self-adhesive labels. Such face materials may include, but are not limited to: smudge proof stock, litho stock, cast coated stock, tag stock, fluorescent stock, foils, computer printable polyester, vinyl, satin cloth, Tyvek™ material, flexible plastic, book papers, photo quality papers and/or photo quality film. Furthermore, various portions of the face materials can be different colors, thereby resulting in different colored parts.

The phrase "printable surface" relates to a surface of any type of matter upon which a person or machine can draw, print, color, paint, photocopy, write, emboss, or make any other type of mark or graphic. Laser printers, ink jet printers, impact printers, thermal transfer printers, direct thermal printers, typewriters, or any other suitable graphic printing devices are preferred but not necessary for use with printable surfaces according to this invention. Customization on the label 34 may include one or more images, patterns, print, pictures, drawings, letters, numbers, words and/or symbols, for example, to relate the gift giver, receiver and/or contents of the gift box to the customization.

As briefly described above, a layer of an adhesive is preferably positioned between back sheet 60 and face sheet 30 so that the adhesive adheres to face sheet 30 exclusively or at least adheres to face sheet 30 more than to back sheet 60 when back sheet 60 is removed from face sheet 30, as described hereafter. As a result of this configuration, the label assembly 10 preferably includes the face sheet 30 having a printable side and an opposite, adhesive side and the back sheet 60 including a separable side and an opposite side.

The face sheet 30 may include one or more labels 34, defined in the face sheet 30 as one or more individual labels 34 according to this invention. The phrases "label," "shape," or the phrase "removable or tearable shape," are intended to relate to a shape, such as the label shape defined by the scored edge 38, that can be removed or torn away from the face sheet, such as the label 34 being removable from a remaining carrier portion 32 of face sheet 30. Specifically, as described below in more detail, the label 34 is preferably dimensioned to cooperate with a particular box blank depending on the size and shape of the gift box desired and an area of the gift box that will be covered by the label.

The scored edge 38 can be formed as any suitable tearable line of separation or weakness and/or cut in face sheet 30 known to those skilled in the art, such as die-cut lines, perforated lines, micro-perforated lines, or any combination of these types of separation, or any other suitable structure that enables separation. A preferred type of scored edge 38 is a line that is die-cut. The label 34 can be die-cut along at least a portion of a periphery, such that the label 34 can be easily removed or separated from the carrier portion 32 of face sheet 30. Occasional material bridge ties can be used to assist in keeping the die cuts from separating during printing, if needed. Alternatively, the die cut may only pass through a portion of the back sheet, thereby holding the line together until torn by the user.

In a preferred embodiment, the label assembly 10 further includes one or more tearable lines 50 in the carrier portion 32. The tearable lines 50 extend from the scored edge 38 and divide up the carrier portion to simplify the process for removing the back sheet 60 from the face sheet 30, as described below. Preferably, the tearable line 50 in the carrier portion 32 can be formed as a line of weakness and/or cut in face sheet 30 known to those skilled in the art, such as die-cut lines, perforated lines, micro-perforated lines, or any combination of these types of separation, or any other suitable structure that enables separation. The tearable lines 50 are shown extending from the label 34 to a peripheral edge of the label assembly 10, and can vary in position and configuration, depending on need and the shape of the label 34.

As shown in FIG. 2, the back sheet preferably includes one or more alignment tabs 62 for aligning the box blank in order to apply the label 34. Each alignment tab 62 preferably comprises a tearable line 64 and a fold line 66 forming a two-dimensional shape such as, but not limited to, a trapezoid, a triangle or a rectangle. In the embodiment of FIG. 2, the tearable line 64 and fold line 66 form a trapezoid-like shape with a bulge in a center portion of the tearable line 64 for grasping. Each tab 62 preferably comprises a tearable line on three sides, and can be formed as any suitable scored and/or cut line in the back sheet 60 known to those skilled in the art, such as die-cut lines, perforated lines, micro-perforated lines, or any combination of these types of separation, or any other suitable structure that enables separation. A preferred type of tearable line 64 is a line that is die-cut. The fold line 66 preferably comprises a fourth side of the alignment tab 62 and can be formed as a line of weakness in back sheet 60 known to those skilled in the art, such as perforated lines, micro-perforated lines, scored or etched line, or any other suitable structure that enables simple folding of the alignment tab 62 to a right angle to the front sheet 30.

Figure 8:
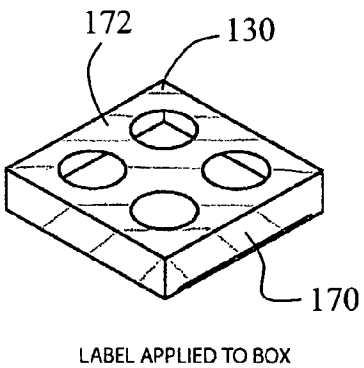
FIG. 8 is an isometric view of the printed face sheet of FIG. 7 applied to a box blank.

In the embodiment of FIG. 2, the back sheet 60 further includes a center portion 68 between the alignment tabs 62. The center portion 68 preferably remains attached to the face sheet 30 to provide rigidity to the label assembly 10 as it is applied to the box blank, particularly if the label is going to form a box top, such as shown in FIG. 8. Alternatively, the center portion may be removed to expose more adhesive.

As shown in FIG. 2, the back sheet 60 further includes one or more removable portions 70, each removable portion 70 is connected to a respective alignment tab 62 at the fold line 66. The removable portion defined by the fold line 66 at one side and at least one removable portion scored line 72 extending from the scored line 64 of the alignment tab 62 to an edge of the label assembly.

Figure 3:
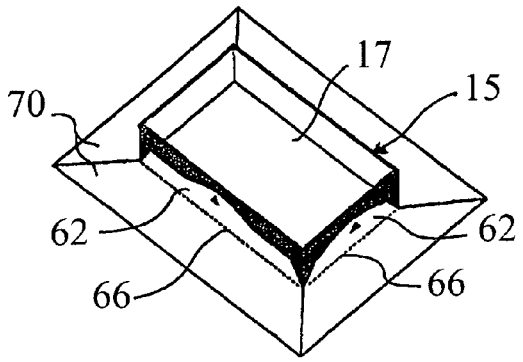
FIGS. 3-5 shows an application of a label to a box blank, according to one embodiment of this invention.

In operation, one or more of the alignment tabs 62 are separated from the face sheet 30, starting at the tearable line 64 and folded to a generally 90 degree angle to the face sheet at the fold line 66, exposing a portion of the adhesive surface of the label 34. As shown in FIG. 3, one or more edges of the box blank 15 are aligned with the respective alignment tab 62 and the box blank is pressed to and adhered to the label 34 at the exposed portions of the adhesive surface. With the box blank partially adhered to the label 34, the removable portion 70 and the face sheet remaining carrier portion 32 are removed, exposing the rest of the adhesive label. In a preferred embodiment, removing the removable portion 70 also separates the label 34 from the carrier portion 32, or vice versa. Preferably, the carrier portion 32 extends along an entire edge of the removable portion 70. The carrier portion 32 is preferably at least ⅜ of an inch wide to improve the separability of the carrier portion 32 from the label 34 without tearing.

Figure 4:
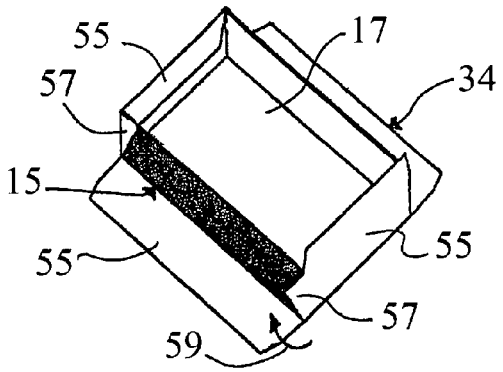
Figure 5:
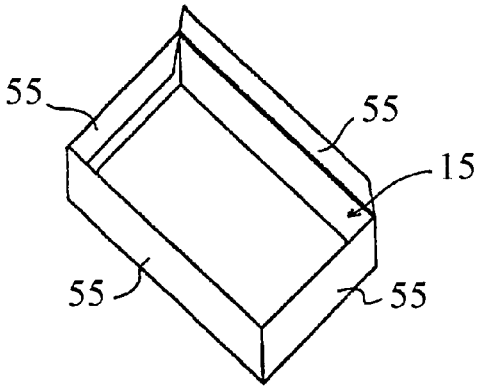

With the removable portion 70 and the carrier portion 32 separated from the label 34, the newly exposed surfaces of the label 34 are folded and secured to the sides of the box blank, as shown in FIG. 4. Additional portions of label 34 preferably extend beyond box bottom 17 of box blank 15 in the form of tabs 55 thereby permitting sidewalls 19 of box blank to be entirely covered by label 50. In addition, one or more extended portions 57 of label tabs 55 preferably extend outwardly from label tabs 55 to permit adjoining of adjacent sidewalls 19 of box blank 15 to form gift box 10. The folding of the extended portions 57 around a box corner is illustrated by the arrow 59. The extended portions 57 are particularly useful where the box blank is not preassembled, such as to allow efficient packaging of the box blank and label together as a kit. FIG. 5 shows the label tabs 55 folded about the box sides.

Figure 7:
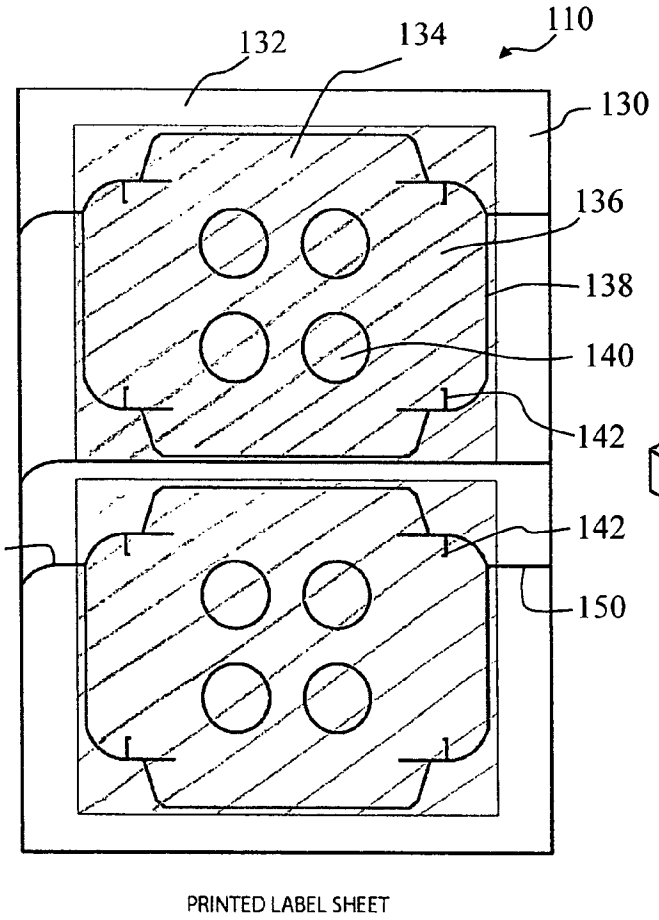
FIG. 7 is a plan view of the face sheet side of the label assembly of FIG. 6 with a shaded square representing a printed image applied to the face sheet.
Figure 6:
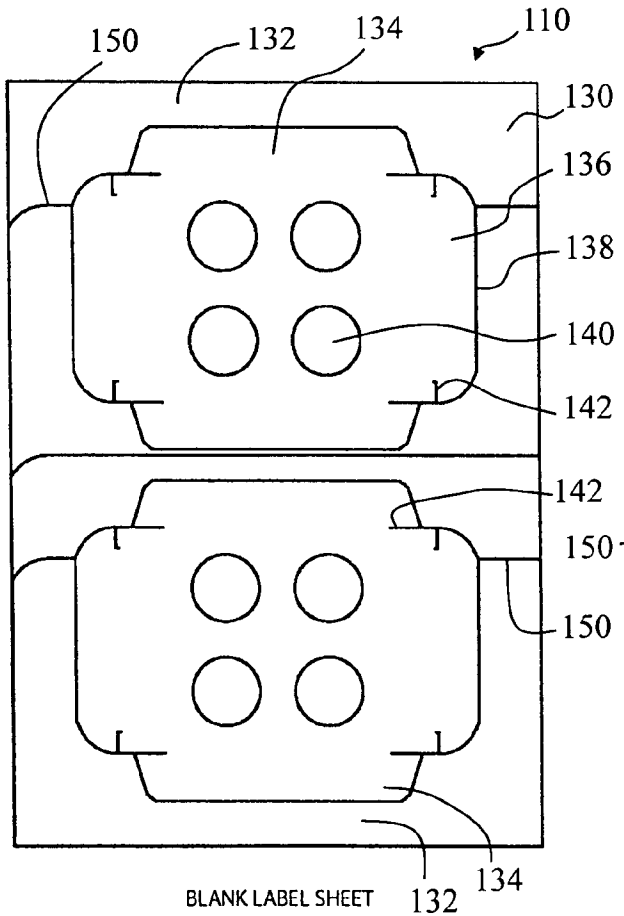
FIG. 6 is a plan view of a face sheet side of a label assembly according to another preferred embodiment of this invention.

FIGS. 6-8 shows an alternative embodiment of a label assembly 110 of this invention. In this embodiment, the label assembly 110 preferably includes a face sheet 130 and a back sheet, not shown, removably adhered to the face sheet 130. The face sheet 130 preferably includes at least one carrier portion 132 and at least one label 134 that is removable from at least a portion of the back sheet and separable from the carrier portion 132. The label 134 is preferably separated from the carrier portion by a scored edge 138 that extends along a perimeter of the label 134 and extends through the face sheet 130 and preferably not the back sheet. Alternatively, the scored line 138 may extend through the face sheet 130 and at least a portion of the back sheet. The label 134 preferably includes at least one printable surface 136 upon which information, decorations, personalization, etc. can be printed to. The back sheet preferably includes the features described above in connection with FIGS. 1 and 2. Alternatively, the back sheet may not include some features described above including but not limited to the alignment tabs.

In the embodiment of FIGS. 6-8, the label assembly includes a pair of labels 134 that are each designed to be applied to a box blank for displaying candy or other similar goods. The box blank and/or the finished box shown in FIG. 8 includes a plurality of openings and a cavity for holding the candy or other similar goods. The plurality of openings can also be sized according to need to hold candy or other objects, such as suspended above the box bottom. Accordingly, the label 134 also includes a plurality of cutouts 140 corresponding to the openings in the box blank. The cutouts 140 can be any suitable size or shape, and are preferably formed by one or more lines of weakness known to those skilled in the art that desirably extend through both the face sheet and the back sheet, such as die-cut lines, perforated lines, micro-perforated lines, or any combination of these types of separation, or any other suitable structure that enables separation of the cutout 140 from the label 134.

In one embodiment, the box blank includes the bottom and sides of the box 170 of FIG. 8. In this embodiment, the label 134 is applied over the top of the box blank and adhered to the sides of the box blank. With this arrangement, the label provides the top to the box 170 and the cutouts 140, cut through both assembly layers, provide access to the interior of the box 170 and/or a holding mechanism. A central portion of the back sheet remains connected to the face sheet 130 to provide rigidity and strength to the label 134 adjacent to the cutouts 140.

In the embodiment of FIGS. 6-8, the label assembly 110 further includes side cuts 142 extending from the scored edge 138. The side cuts 142 are preferably formed as a line of weakness known to those skilled in the art, such as die-cut lines, perforated lines, micro-perforated lines, or any combination of these types of separation. The optional side cuts 142 improve the foldability and application of the label 134 to the box blank.

In a preferred embodiment, the label assembly 110 further includes one or more tearable lines 150 in the carrier portion 132. The tearable lines 150 extend from the scored edge 138 and divide up the carrier portion to simplify the process for removing the carrier portion 132 and/or back sheet from the face sheet 130, such as by providing a strip to remove. The tearable line 150 in the carrier portion 132 can be formed as a line of weakness and/or cut in face sheet 130 known to those skilled in the art, such as die-cut lines, perforated lines, micro-perforated lines, or any combination of these types of separation, or any other suitable structure that enables separation.

While in the foregoing specification this invention has been described in relation to certain preferred embodiments thereof, and many details have been set forth for purpose of illustration, it will become apparent to those skilled in the art that the invention is susceptible to additional embodiments and that certain of the details described herein can be varied considerably without departing from the basic principles of the invention. Therefore, to particularly point out and distinctly claim the subject matter regarded as the invention, the following claims conclude the specification.

What is claimed is:

1. A customizable gift box label assembly, comprising:

a face sheet having a printable surface including a label sized to cover a box blank;

a back sheet including a center portion and a removable portion extending around the center portion, the removable portion partially overlaying the label and removable to expose an adhesive surface of the label within the face sheet;

a plurality of alignment tabs cut in the back sheet and each extending along a corresponding side of the center portion, each of the alignment tabs separated from the center portion by a tearable line of separation and including a fold line in the removable portion of the back sheet and parallel to at least a portion of the corresponding side of the center portion, wherein the plurality of alignment tabs comprises four alignment tabs, the center portion comprises four corresponding sides, and each of the four alignment tabs extends along an entirety of one of the four corresponding sides of the center portion.

2. The label assembly of claim 1, wherein the removable portion comprises a plurality of sections each including one of the plurality of alignment tabs.

3. The label assembly of claim 1, further comprising a plurality of second tearable lines extending from the center portion to a peripheral edge of the label assembly.

4. The label assembly of claim 3, wherein each of the plurality of second tearable lines divides the removable portion into a plurality of removable sections.

5. The label assembly of claim 3, wherein each of the plurality of second tearable lines defines a side of at least one of the plurality of alignment tabs.

6. The label assembly of claim 1, wherein a first of the plurality of alignment tabs is separated from a second of the plurality of alignment tabs by a second tearable line of separation.

7. The label assembly of claim 1, further comprising a tearable line of separation extending from the label to a peripheral edge of the label assembly.

8. The label assembly of claim 1, further comprising a tearable shape cut in the face sheet within the label.

9. The label assembly of claim 1, further comprising a box blank sized to fit over the center portion and within the plurality of alignment tabs.

10. A method of customizing a box with a customizable gift box label assembly comprising a face sheet having a printable surface including a label sized to cover a box blank, a back sheet including a center portion and a removable portion extending around the center portion, the removable portion partially overlaying the label and removable to expose an adhesive surface of the label within the face sheet, and a plurality of alignment tabs each extending along a side of the center portion, each of the alignment tabs separated from the center portion by a tearable line of separation and including a fold line in the removable portion, the method comprising:

raising the alignment tabs about the fold lines to expose adhesive material;

aligning a box blank between the plurality of alignment tabs;

adhering the box blank to the adhesive material; and folding the label about the box blank.

11. A customizable gift box label assembly, comprising:

a face sheet including a label sized to cover a box blank;

a back sheet including a center portion;

a plurality of alignment tabs cut in the back sheet and each extending along and abutting the center portion;

a first tearable line of separation extending between the center portion and each of the plurality of alignment tabs;

each of the alignment tabs including a fold line comprising a line of weakness formed in the back sheet that is opposite and parallel to a portion of the first tearable line of separation, and a plurality of second tearable lines of separation each cut extending between and connecting an end of the first tearable line of separation and the fold line.

12. The label assembly of claim 11, wherein each of the alignment tabs is connected to a removable portion of the back sheet by the fold line.

13. The label assembly of claim 11, further comprising each of the plurality of second tearable lines extending from the center portion to a peripheral edge of the label assembly.

14. The label assembly of claim 13, wherein each of the plurality of second tearable lines divides the back sheet into a plurality of removable sections.

15. The label assembly of claim 13, wherein each of the plurality of second tearable lines defines a side of two of the plurality of alignment tabs.

16. The label assembly of claim 11, wherein each of the plurality of alignment tabs is separated from an adjacent one of the plurality of alignment tabs by one of the second tearable lines of separation.

17. The label assembly of claim 11, further comprising a plurality of tearable shapes cut in the face sheet within the label.

18. The label assembly of claim 11, further comprising a box blank comprising a box bottom and at least two sidewalls, wherein the box blank is sized to fit over the center portion and within and against the plurality of alignment tabs when raised.

19. The label assembly of claim 11, wherein the plurality of alignment tabs comprises four alignment tabs, the center portion comprises four corresponding sides, and each of the four alignment tabs extends along an entirety of one of the four corresponding sides of the center portion.

20. The label assembly of claim 11, wherein each of the plurality of second tearable lines extends from one end of the first tearable line of separation and in a direction away from the center portion and contacts an end of the fold line.

* * * * *